United States Patent [19]

Kuhn

[11] 3,983,716

[45] Oct. 5, 1976

[54] JEWELRY LOCK WITH AT LEAST ONE HITCH FOR SUSPENDING PIECES OF JEWELRY

[76] Inventor: Heinrich Kuhn, Haussmannstrasse 65, 7070 Schwaebisch Gmuend, Germany

[22] Filed: Dec. 17, 1974

[21] Appl. No.: 533,643

[30] Foreign Application Priority Data

Dec. 22, 1973 Germany ..... 7345578[U]
June 5, 1974 Germany ..... 2427044

[52] U.S. Cl. ..... 63/1 R; 24/116 A; 63/20; 63/23

[51] Int. Cl.[2] ..... A44C 11/02

[58] Field of Search ..... 63/1 R, 2, 20, 23; 24/116 A, 73 J

[56] References Cited

UNITED STATES PATENTS

| | | | |
|---|---|---|---|
| 689,232 | 12/1901 | Schoch | 63/2 |
| 1,265,778 | 5/1918 | Hartline | 59/93 UX |
| 1,455,993 | 5/1923 | Conway | 63/2 UX |
| 1,578,940 | 3/1926 | Wacha | 63/2 UX |
| 1,771,129 | 7/1930 | Lampl | 63/1 R |
| 2,051,591 | 8/1936 | Brogan | 63/2 X |
| 2,586,758 | 2/1952 | Zerr | 24/116 A |
| 3,168,768 | 2/1965 | Bohlinger et al. | 63/2 X |

*Primary Examiner*—Louis G. Mancene
*Attorney, Agent, or Firm*—Otto John Munz

[57] ABSTRACT

A jewelry lockcase in combination with a plurality of hitches pivotally anchored within hollows of the case and protruding therethrough with means of attachment of the case to a chain for the neck, to a band for the wrist of the wearer, to desired jewelry, or as a pin to the wearer's clothing.

Means are provided for an easy assembly of the case with the anchor of the hitch.

In several embodiments the hitch is a hollow tube including a hollow anchor, with a string knot positioned in the anchor, a spacer sleeve over the hitch abuts the outer wall of the case, followed by a stop-bead threaded over the tube adjacent to the sleeve, the string is threaded through the tube and beads are threaded onto the string extending from the tube.

15 Claims, 14 Drawing Figures

JEWELRY LOCK WITH AT LEAST ONE HITCH FOR SUSPENDING PIECES OF JEWELRY

CROSSREFERENCE TO RELATED APPLICATION

Priorities of German Pat. application No. P 24 27 044.6 filed June 5, 1974 and German application G 73 45 578 filed Dec. 22, 1973 are claimed under the Convention.

FIELD OF THE INVENTION

The invention relates to a jewelry lock with at least one hitch for suspending chains, ornamental pins, or the like pieces of jewelry hitched to the jewelry lock.

DESCRIPTION OF THE PRIOR ART

The prior art employs for use on chains, ornamental pins, or the like pieces of jewelry, only spring locks or clasp-operated closures. In such devices a jewelry lock is provided at one end of a chain and a hinge for attaching the chain by suspension or by means of a catch mechanism, to the jewelry lock at the other end thereof. Such closures are difficult to handle and do not provide a satisfactory safety against an accidental opening of the closure. Conventional jewelry locks are ordinarily rigidly or fixedly connected with a chain or the like piece of jewelry, and can be used only together with such piece of jewelry. A replacement of the jewelry lock can be carried out usually by a jeweler only. Nor can more than two chain ends be connected by means of a single jewelry lock in any known jewelry lock. Furthermore, most of the known jewelry locks present no particularly artfull appearance since the individual elements of the closure mechanism are frequently visible. Moreover, in known jewelry locks it is difficult to mount a hinge on a chain thread or another jewelry lock.

SUMMARY OF THE INVENTION

The primary object of the invention is to provide a combination of a jewelry lock with at least one hitch attached thereto by suspension, which avoids the aforementioned shortcomings.

Another object of the invention is to provide a jewelry lock, which can be handled easily and very safely.

Still another object of the invention is to provide a jewelry lock which permits several possibilities of easy replacement of jewelry and of attachments with a number of chain ends and/or of pieces of jewelry.

Other objects of the invention and many of its advantages will become obvious to those skilled in the art from the following description and drawings.

BRIEF DESCRIPTION OF THE DRAWINGS

FIG. 4 is an enlarged sectional view of the hitch of the invention, mounted at the end of a bead chain;

FIG. 5 is a rear view of the jewelry lock shown on FIG. 1, with four bead chain ends suspended therefrom;

FIG. 6 is a representation corresponding to FIG. 5, showing a different arrangement of the jewelry lock;

FIG. 7 is a front view of the jewelry lock shown on the preceding figures, suspended, as a pendant, from a chain;

FIG. 8 is a rear view of the device shown in FIG. 7;

FIG. 9 shows the hitch used in the device of FIGS. 7 and 8, suitable for attachment to a chain for the purpose of suspending it from the jewelry lock.

FIG. 10 is a rear view of the jewelry lock of the invention having an ornamental unfolded pin inserted therein;

FIG. 11 is a side view of the pin of FIG. 10 in closed position;

Figure 1:
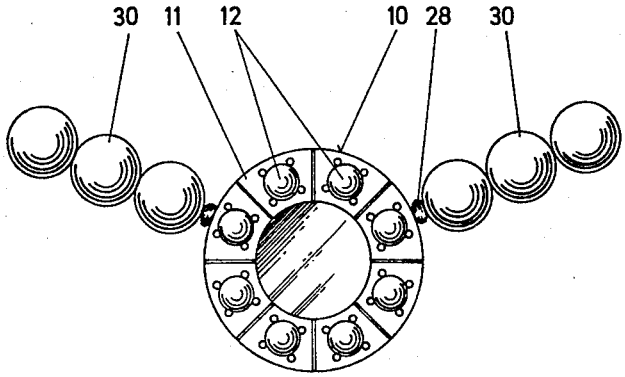
FIG. 1 is a front view of one embodiment of the jewelry lock, with two bead chain ends suspended therefrom.

Combinations of the embodiments shown are within the scope of the invention.

In the drawings the same or equivalent parts are often indicated by the same reference numerals and repetitions of depictions of parts common to the various showings are omitted for brevity purposes.

DESCRIPTION OF THE PREFERRED EMBODIMENTS

These objects are achieved, according to the invention, by means of an at least partially hollow lockcase in combinations with hitches shaped like bolts, each hitch provided with an anchor, which can be locked in the hollow of the case, while the hitch protrudes through the case, with an opening in the case being partially closed.

The base and the face of the case may be folded for locking the anchor, after it has been inserted in the opening, and when the case is closed, at least two openings for the passage of the hitches therethrough are provided.

For purposes of this disclosure a hitch defines a means to connect a lock case with means of its attachment for connection with a pin, a necklace or chain to fasten it to the body or clothing of the wearer and for carrying or supporting jewelry, such as a string of pearls, a jewelled pin or a pendant, flexibly, by suspension.

The shape of the hitch permits insertion of its anchor into the hollow of the case and the safe locking thereof by folding a hinge, leaving free a passage for protrusion of the hitch, which is so small that while the hitch is fastened movably in the case, its anchor cannot move out of the case. The lock case itself may be a piece of jewelry and its face may be suitably ornamented and/or studded with gems. By a very simple means of attachment of the hitches to, and their removal from the case, a chain, a pin, a pendant or a string of beads or other piece of jewelry can be very easily detached from the case, and replaced by other pieces.

In order to improve on the normally very difficult mounting of jewelry, each hitch has the shape of a tube provided with a continuous hollow space and with a hollow anchor at one end, through which a string passes and is knotted with a knot to fit the hollow of the anchor. The mounting of jewelry, hitherto a tough problem in the manufacture of chains and other pieces of jewelry, has thus become extremely simple since only the end of a chain or a string of another piece of jewelry must be threaded through the hollow hitch and tied into a knot. Thereby the hitch is fixed to the string and case in an entirely safe and new manner.

The hollow space of the hitch widens preferably into a cup shape within the anchor and there the knot is hidden and invisible from the outside.

In a further advantageous development of the invention, the hitch is manufactured simply by soldering the enlarged anchor onto the non-enlarged section of the hitch. The anchor may be, for instance, a milled-out hemisphere, while the remaining portion of the hitch may be made a simple small tube, rigid or at least partly flexible, as desired, for the shaping of the jewelry.

In a further improvement of the means to secure the hitch to the end of a chain, or a similar piece of jewelry, such as a string of beads, or a pearl necklace, the non-enlarged portion of each tubular hitch, extension 34, is provided with a spacer sleeve 36 interposed between the outer wall opening and a portion of the adjacent jewelry, such as a bead. To utilize this advantage, the adjacent jewelry part, such as the last bead of a chain, a stop bead is provided with a bore into which is inserted a portion of the hitch tube that projects beyond the spacer sleeve, and the sleeve is interposed between the wall of the case and the bead to abut against them. The string supporting the beads is knotted behind the anchor only after insertion of the hitch into the sleeve and the stop-bead, so that the hitch is fixed on one side through the anchor to the string and the case, and the individual ornamental parts of the piece of jewelry, such as the beads of the string, are firmly held together locked on the other side, such as by another knot in the string or conventional other means of attachment.

For specific configurations of beads of pearls the stringing of beads including the mounting of the hitches is carried out in such a way that the string is pulled through the hollow hitch and anchor and knotted behind the latter. Then the spacer sleeve and a bead with a bore in succession are slid over the hitch from the end opposite of the anchor. Thereafter all the other beads are threaded onto the string protruding through the hitch. Subsequently the string is threaded through a second hitch, which again is inserted in a spacer sleeve and likewise provided with a bore. This assembly is extremely simple and safe.

In a preferred embodiment, the hollow lock case has the passage openings for the non-enlarged section of the hitches approximately opposite each other. In this embodiment it is not only possible to shape the jewelry case itself as a piece of jewelry and use it for joining chain ends, but it may also itself be shaped, such as as a small round anchor bead, so that it is not particularly conspicuous in a sequence of beads of a bead chain. In this case, it is preferable to divide the case into two halves which can be unfolded with respect to each other and closed with the anchor beads locked in.

In order to avoid imparting the jewelry lock an unfavorable center of gravity and to prevent its tilting and exposing the less decorative base the lock case has a disc shape and is provided in its base with a central opening with at least two elongated anchor guiding slots running radially from a central opening in the base into the wall of the case, to permit insertion of the anchor through the opening and sliding it adjacent the wall. For this purpose the diameter of the anchor is larger than the width of the slots in the surface of the base. A closure strap is also hingedly attached to the base which in the position of closure covers the opening.

In this preferred embodiment, only the anchors must be inserted in the central base opening to be slid toward the wall within the radial slots so that the hitches themselves dangle outward from the walls of the disc-shaped lock case. Then the central opening is closed by means of the closure strap. The closure strap, however, is not subject to a load since the hitches practically do not touch it even during excessive movements of the jewelry. When the slots enclose an angle different from 180°, the jewelry lock abuts in a flat manner and does not tend to tilt over.

Any desired number of such slots can be arranged in the base of the jewelry lock radially at any desired angles, so that more than two jewelry-string or chain-ends can be suspended from the jewelry lock. When such as a necklace or a chain, held together by the jewelry lock is worn around the neck, a second chain or one or more pendants each attached to a single hitch shaped according to the invention may be added to dangle downward from the jewelry lock.

Preferably, the closure strap is secured by providing a snap-in pin at its outer end, which by pressure snaps into a correspondingly positioned snap-in hole in the base of the lock case.

As a further example of the many variations in the possible designs and arrangements, the present invention readily, without creating any difficulties in manufacture, makes it possible that more than two radial slots may be provided in the base of the lock case, preferably arranged in specular symmetry. Thus, for instance three slots in the form of a Y or, in suitable further development, also several slots may be provided, of which each two are positioned in a straight line. A straight slot passing through the entire base of the lock case and functioning as an ornamental pin creates a jewelry lock which can also be worn separately as an ornamental pin. By closing the closure strap, the ornamental pin is safely fixed on the jewelry lock.

By the selection of arrangement and number of slots, any desired combination of jewelry pieces or the like to be suspended from the jewelry lock can be made possible. Of course, the invention is also applicable for hand bracelets and other pieces of jewelry.

Figure 3:
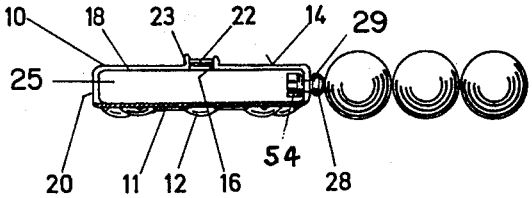
FIG. 3 is a sectional view along the line III—III of FIG. 2.
Figure 4:
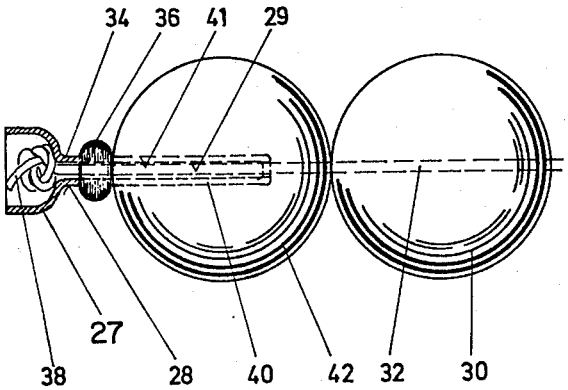
FIGS. 4 to 11 depict various exemplary combinations of the jewelry lock with hitches and jewelry hitched thereto.

Thus, in its simplest embodiment the invention comprises a jewelry lock case, at least partly hollow 25 (FIG. 3.) and provided with holes, 70 (FIG. 14) in its walls in combination with at least one hitch 34, in FIG. 4, each hitch having an anchor 54, anchored within the hollow 25 (FIG. 3) of the case and protruding through a hole 70 thereof with an extension 28 (FIG. 4) for means to connect the case with the wearer's body, f.i. by a pearl necklace or closing such as by a pin, and/or jewelry.

In the embodiment shown on FIGS. 1 to 4 a hollow lock case 10, has a face 11 provided with ornaments 12, such as gems, a base 14, at least one side wall 20 connecting the face and the base and orifices 70 in the wall. The case is not limited to the disc shaped depicted. A spherical, eliptical, polygonal, symmetrical, or assymmetrical shape may be given to the case instead.

Figure 9:
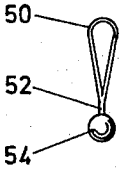
Figure 14:
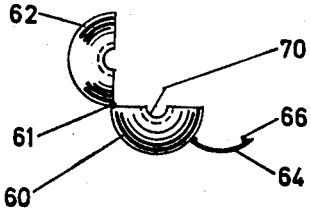
FIG. 14 is a side view of the jewelry lock shown on FIG. 13.

A simple manner of connecting the hitch with the case is indicated on FIGS. 9 and 14, permitting, prior to to closing the case, the anchor of the hitch to be inserted into the hollow of the case and thereafter to close the two hinged hemispheres shown on FIG. 14 with the hitch protruding through an orifice thereof.

Figure 2:
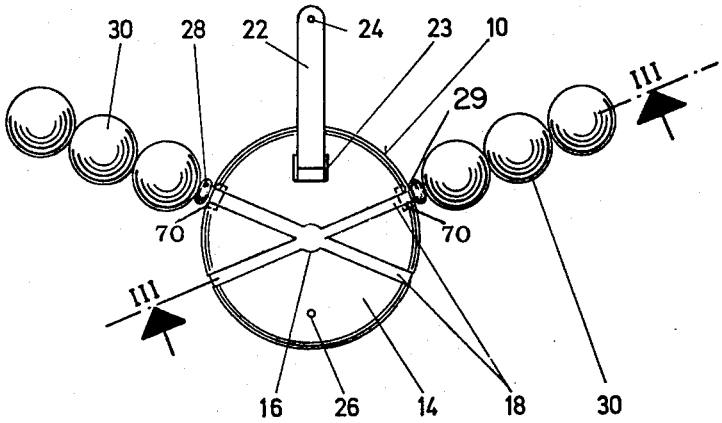
FIG. 2 shows a rear view of the device shown on FIG. 1.

An improvement thereover is depicted on FIGS. 2 and 4, where the base is provided with a central hole 16 from which extend four slots 18 radially through holes 70 of the side wall, shown on FIG. 2 as two pairs of slots, symmetrically angled from each other.

Each two opposing slots of these four slots are in alignment along lines III—III of FIG. 2.

As an essential component part of the lock case, there is provided at least one hitch 28.

The hitch 28 shown on FIGS. 1 to 4 is an elongated rigid or flexible tube 34 with a hollow 25, with an enlarged hollow end cup-shaped anchor 54, protruding into the case, enclosed by the side wall orifice 70 and extending out of the case securely and slightly pivotally.

A ball bearing type tubular sleeve 36 fastened over the tube keeps the anchor in the tight fixed but pivotable attachment with the case.

The base 14 supports a pin 24. A closure strap 22 is pivotally hinged to the base adjacent to the base opening by means of a hinge 23. By folding the strap and pushing the pin by pressure into a hole 26 in the base, the pin can be bolted there, snapped in or otherwise firmly secured.

It can, however, be opened by hand easily and it closes safely since it is not loaded by suspended pieces of jewelry.

The diameter of the anchor of the hitch corresponds to the diameter of the hole on the base to permit insertion therethrough, but the width of the hitch itself is greater than the width of the slot to prevent its slipping out therethrough.

Thus after the insertion of the anchor into the hollow and closing of the closure strap the anchor is movably secured in the lock case. Through the hollow of the hitch and of the anchor there is threaded a chain or a thread 32, such as for a string of pearls 30 and knotted with one end into a knot 38 of a size to fill safely the cup-shaped anchor 54 to prevent slipping thereof therethrough into the tube of the hitch.

When the string of pearls is attached, as shown on FIG. 1, the base of the lock case abuts flatly against the skin or clothing of the wearer, since the hitches move outward to the case surface and exert a radial outwardly directed pull upon the lock case. When the two chain ends are inserted in two slots which form an angle, as shown on FIGS. 1 and 2, a tilting of the lock case becomes impossible, since the center of gravity of the lock case is located below the immaginary horizontal connecting line between the points of pull of the two hinges on the lock case.

As can be seen on FIG. 4, each hitch is approximately bolt-shaped and presents, in addition to the enlarged anchor at one end the tubular section 34. A radial spacer sleeve 36 is mounted over the tube adjacent to the wall. The end 40 of the tube opposite the anchor is inserted into a corresponding bore provided for this purpose in the adjacent bead 42 of the string of pearls.

Thus the anchor with the tube protruding through the wall and held against it by the sleeve and the first bead add to the safety of the attachment provided by the tightened string.

Figure 5:
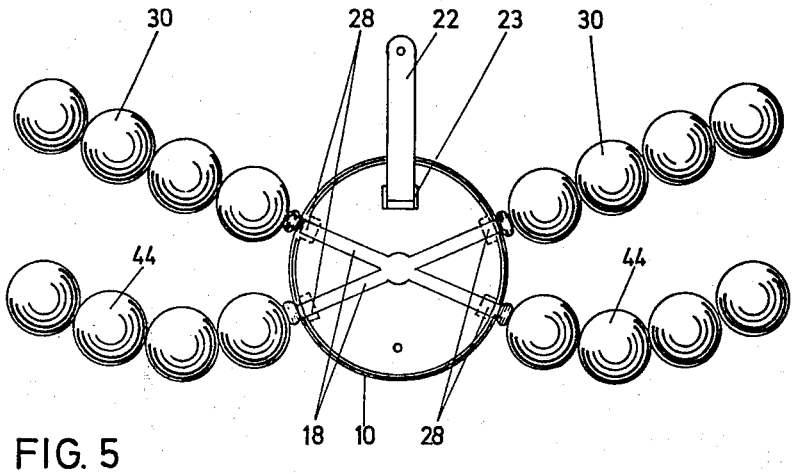

In the arrangements of FIG. 5 the parallel ends of two pairs of bead chains 30 and 44 are suspended, by means of two hitches. The hitches may be flexible permitting any desired shaping of the configurations of the beads.

Figure 6:
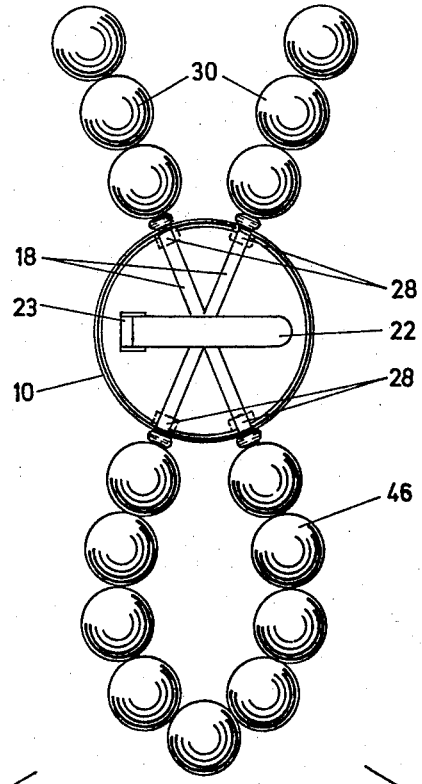

In the arrangement shown on FIG. 6, the lock case is turned, with respect to that of FIG. 5, by 90°, and a bead chain 30 is suspended, by means of two hitches 28, from two slots 18 extending at an acute angle, while a short bead pendant 46 is suspended, likewise by means of two hinges 28 from the opposite slots 18 which likewise enclose an acute angle.

A closure strap 22 is shown closed over the opening 16. The exemplary arrangements of FIGS. 5 and 6 clearly indicate many varied possibilities of use of the jewelry lock of the invention with hitches.

Figure 7:
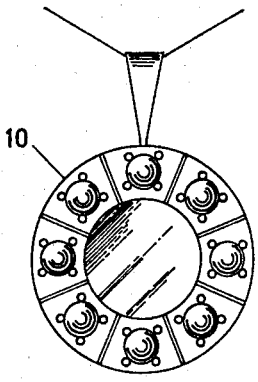
Figure 8:
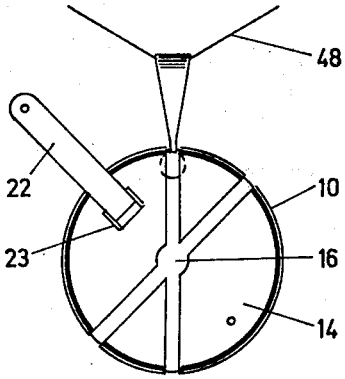

FIGS. 7 to 9 show another possibility of use of the lock case 10 of the invention. The jewelry lock itself may beautifully shaped adorned to be worn as a pendant on a chain 48. For this purpose a suspension eye 50, attached to a chain 48, has at its end fastened a hitch 52 whose free end supports the anchor 54.

The hitch 52 and anchor may have the same dimensions as those described with respect to FIGS. 2 and 4 and can be inserted, in the same manner, into the opening 16 of lock case 10, as with respect to the hitch. For the bolting in this case a pivotable closure strap 22 also is provided. Thus the jewelry lock can be connected within seconds rapidly and safely with variagated pieces of jewelry or their parts.

Figure 10:
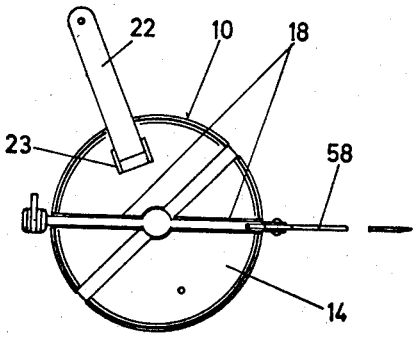
Figure 11:
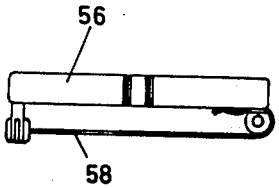

Another possible use of the lock case 10 is depicted on FIG. 10. A bridge 56 of an ornamental pin 58, which is shown separately on FIG. 11 and which for purposes of this invention becomes equivalent to the hitch thereof, is inserted into two slots 18 in the base of the case which are in a straight alignment. When the ornamental pin 58 is opened, the closure strap 22 can be closed, so that the lock case 10 is safely connected with the ornamental pin. Thus the lock case may also be worn as an ornamental pin.

Figure 12:
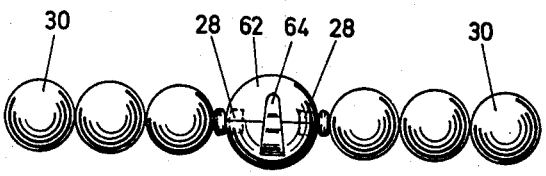
FIG. 12 is a front view of another embodiment of the jewelry lock, showing two bead chain ends suspended therefrom.
Figure 13:
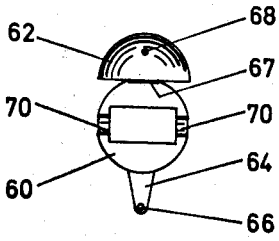
FIG. 13 is a plan view upon the unfolded jewelry lock according to FIG. 12.

Another ornamental embodiment of the jewelry lock having the external shape of a bead is shown on FIGS. 12 to 14. It has a lower hemispheric cup 60 with an upper hemispheric cup 62 hinged thereto so that it can be unfolded by means of a hinge 61. A closure strap 64, which likewise supports again a snap-in pin 66 is fastened to the lower ball cup 60. The pin again representing the hitch of the invention is to be snapped into hole 68 in the upper cup 62 by snap-in pressure. Both the lower and the upper cups have at their edges diametrally opposite recesses 70 which form orifices to hold the hitch when the lock case 60, 62 is closed. As indicated on FIGS. 13 and 14, two hitches 28 according to FIG. 4 may be inserted which in each case are fastened to the two ends of a bead chain 30, in a manner likewise shown in greater detail on FIG. 4. Subsequently, the two cups 60 and 62 are folded, so that the anchors 54 of the hinge 28 are fixed within the folded lock case, and thus, the two chain ends are connected. By means of this embodiment of the jewelry lock various different chains and chain parts and pieces of jewelry can be connected in any desired way, thus providing further possibilities of combinations, alone and in connection with the embodiments shown on FIGS. 1 to 3.

What is claimed is:

1. A jewelry lock in combination with at least one hitch for the attachment of jewelry such as a string of beads. comprising:

a case, having a hollow;

at least one tubular hitch having an enlarged hollow anchor and a hollow hitch extension;

means for detachably securing said enlarged hollow anchor within said case, said means including an opening in the wall of said case for each said hitch extension;

said anchor mounted within said hollow with said hitch extension protruding through said opening;

a spacer sleeve mounted over said hitch extension adjoining the outside of said opening;

a tubular hole within said jewelry mounted over said hitch extension adjacent to said spacer sleeve and a string threaded through said hollow hitch extension and into said jewelry and having one end knotted and retained within said hollow anchor.

2. A jewelry lock as claimed in claim 1, said at least one hitch being at least two hitches on opposite sides of the said case, the anchor of each hitch being on one end of a string from a string of beads.

3. A jewelry lock as claimed in claim 1, the said anchor being soldered to the hitch extension.

4. A jewelry lock as claimed in claim 1, said at least one hitch being two hitches with an opening for each approximately opposite each other.

5. A jewelry lock as claimed in claim 1, said case having face and base with means to lock them together with the anchors positioned within the case and the hitch extensions protruding through openings in the sides of the case.

6. A jewelry lock as claimed in claim 5, further comprising:

at least two opposite openings in the side wall for each hitch.

7. A jewelry lock as claimed in claim 1, the said anchor being widened for holding the knot.

8. A jewelry lock as claimed in claim 1, said case being disc-shaped and provided in its base with a central opening and at least two radial slots at an angle to each other, said slots connected with the openings and extending into the surface of the base of the lock case, the diameter of the central opening being slightly larger than that of the anchor, the width of the slots in the base surface being slightly larger than the diameter of the hitch extension.

9. A jewelry lock as claimed in claim 8, further comprising a closure strap hinged with one end to one side of the base, to cover the central opening and provided at its other end with a snap-in pin, said base provided with a snap-in hole spaced to mate with said snap-in pin on closing the strap.

10. A jewelry lock as claimed in claim 1, there being a plurality of slots arranged in specular symmetry.

11. A jewelry lock as claimed in claim 10, each two of said plurality of slots being positioned in a straight line.

12. A jewelry lock as claimed in claim 1, further comprising:

means including a hinged member to lock said anchor within said hollow with said hitch extension protruding therethrough.

13. A jewelry lock as claimed in claim 1, further comprising:

means on the outer end of said hitch extension for the attachment of said string.

14. A jewelry lock as claimed in claim 1, said hitch being flexible at least in its said hitch extension.

15. A jewelry lock as claimed in claim 1, said hitch being rigid.

* * * * *